US010968582B2

(12) United States Patent
Filippov

(10) Patent No.: US 10,968,582 B2
(45) Date of Patent: Apr. 6, 2021

(54) HORIZONTAL ROAD SURFACE MARKING

(71) Applicant: Aleksandr Vyacheslavovich Filippov, Moscow (RU)

(72) Inventor: Aleksandr Vyacheslavovich Filippov, Moscow (RU)

( * ) Notice: Subject to any disclaimer, the term of this patent is extended or adjusted under 35 U.S.C. 154(b) by 0 days.

(21) Appl. No.: 16/347,853

(22) PCT Filed: Oct. 5, 2017

(86) PCT No.: PCT/RU2017/000742
§ 371 (c)(1),
(2) Date: May 7, 2019

(87) PCT Pub. No.: WO2018/093293
PCT Pub. Date: May 24, 2018

(65) Prior Publication Data

US 2019/0323185 A1 Oct. 24, 2019

(30) Foreign Application Priority Data

Nov. 16, 2016 (RU) ..... RU2016144993

(51) Int. Cl.
*E01F 9/524* (2016.01)

(52) U.S. Cl.
CPC ..... *E01F 9/524* (2016.02)

(58) Field of Classification Search
CPC ..... E01F 9/524; C09C 1/3684
(Continued)

(56) References Cited

U.S. PATENT DOCUMENTS 3,215,051 A * 11/1965 Gill, Jr. ..... E01F 9/518 404/14
3,936,207 A * 2/1976 Sticha ..... E01F 9/50 404/14

(Continued)

FOREIGN PATENT DOCUMENTS

JP 2003344624 A 12/2003
KR 10-1901915 * 3/2018 ..... C09C 1/3684
RU 98014 U1 9/2010

*Primary Examiner* — Raymond W Addie
(74) *Attorney, Agent, or Firm* — John Alumit

(57) ABSTRACT

Road markings made of special materials with reflective additives (micro-glass beads) that increase the retroreflection factor of the road marking independent of the color (whiteness, brightness) of the road marking material (thermoplastic, cold plastic, paint). Light sources, such as car headlights, emit radiation, including in the form of visible light. A major portion of the light beams directly incident onto a pavement (6) is absorbed. According to the first embodiment, a portion of all incident light beams is partially reflected directly from a road marking layer (4) and returned in the opposite direction. In both embodiments, a portion of the light beams is incident upon an extending portion (1). Since no additional layer (8) is present on the surface of the extending portion (1), the light beam is partially reflected and, upon refraction, passes inside a micro-glass bead (2). Having passed through the micro-glass bead (2), the light beams are almost completely reflected from the interface between the glass and additional layer (8), which is present along the entire surface of the micro-glass bead (2), except for the extending portion (1). Most of these reflected light beams is returned to the light source.

4 Claims, 2 Drawing Sheets

(58) Field of Classification Search
USPC ..... 404/12–16, 72, 75
See application file for complete search history.

(56) References Cited

U.S. PATENT DOCUMENTS

| | | | | | |
|---|---|---|---|---|---|
| 4,983,458 | A * | 1/1991 | Dejaiffe | B29C 43/085 | 359/540 |
| 5,039,557 | A * | 8/1991 | White | E01C 23/166 | 404/75 |
| 5,128,203 | A * | 7/1992 | Laroche | G09F 3/00 | 428/325 |
| 5,227,221 | A * | 7/1993 | Hedblom | B05C 1/12 | 404/12 |
| 5,456,546 | A * | 10/1995 | Bollag | E01C 7/35 | 404/9 |
| 10,066,349 | B2 * | 9/2018 | Carlson | E01C 11/24 | |
| 2003/0123931 | A1 * | 7/2003 | Khieu | E01F 9/512 | 404/12 |
| 2016/0230018 | A1 * | 8/2016 | Fage-Pedersen | C03C 12/02 | |

* cited by examiner

HORIZONTAL ROAD SURFACE MARKING

FIELD OF THE INVENTION

The invention relates to road construction, and specifically, to road marking using special materials (road-marking materials) with reflective additives (micro-glass beads) applied thereto.

PRIOR ART

To organize traffic, road marking is used, which should be visible at any time of the day under any conditions. The road-marking materials have a color contrasting the color of the road surface (white, orange, yellow). In addition, micro-glass beads are used. The action principle in this case is that the light beam from the headlights enters the micro-glass bead through a convex free surface, while refracting at the "air-glass" interface towards the center of the micro-glass bead, then hits the lower side of the micro-glass bead, the surface of which is in contact with the marking material and, therefore, represents an analogue of a concave mirror, gets reflected from it, and through the "glass-air" interface, upon refraction, returns in the direction opposite to the direction of the incident beam.

A reflecting system is known (U.S. Pat. No. 4,012,114; publication date: Mar. 15, 1977), which is a part of the road marking. The reflecting system comprises a glass sphere, a transparent binding medium, and a multitude of smaller glass spheres. Around the surface of the larger glass sphere, there are smaller glass spheres, which are evenly distributed within a single layer. A transparent binding medium is distributed between the larger and smaller glass spheres. This system is located on the surface in the upper layer of the road marking. A beam incident onto such marking returns exactly in the opposite direction. As a result, the retroreflection of the marking increases. Subsequently, the visibility of the road marking also increases.

The disadvantage of the analog is the complexity of the reflecting system, namely the complexity of the uniform distribution of the smaller spheres along the surface of the larger sphere.

The closest technical solution (prototype) is the road marking performed in accordance with par. 6.2.5. of the road industry procedure "Methodical recommendations for implementing a horizontal road marking by the airless method" approved by order No. OC-450-r of the Federal Road Agency (Rosavtodor) on Jan. 1, 2001. This road marking consists of a layer of road marking material deposited onto the surface (road) and micro-glass beads. The micro-glass beads are coated with a special compound (silicone, transparent glue, silane, siloxane). The beads coated with such special compound are applied to the marking material. This enables sticking of the micro-glass beads to the marking material, as well as even distribution of the micro-glass beads either on top of the material of the road marking layer, or with partial embedment. In the process of micro-glass beads application, gas-filled microvoids are formed at the interface between the micro-glass beads, surface layer of the special compound, and the road marking material layer.

The disadvantage of this known solution is an insufficient visibility of the marking. This is due to the fact that part of the light beam that has passed through the micro-glass beads is trapped within the microvoids between the micro-glass bead surface (also containing a layer of the special compound) and road marking material layer, where it gets absorbed or scattered, or returned to the glass at the arbitrary angles. Because of this, when the light beam returns to the light source, it is significantly weakened.

The technical result of the proposed invention consists in increasing the retroreflection factor of the road marking and making it independence of the color (whiteness, brightness) of the material forming the road marking layer (thermoplastic, cold plastic, paint).

This technical result is achieved by the fact that according to the first embodiment, in the horizontal road marking containing a road marking layer with a first surface and a second surface, where the first surface faces the transport moving along the road surface, and the second surface is placed on the road surface, the road marking layer contains partially embedded micro-glass beads provided with an extending portion located above the first surface, wherein, within the road marking layer, said micro-glass beads are provided with an additional layer located on their surface and made of an easily-removable light-type material (in one particular case, said easily-removable material represents a water-color paint; in another particular case, said easily-removable material represents a metal-containing paint; in yet another particular case, said easily-removable material represents a gouache; in yet another particular case, said easily-removable material represents an orange-colored material; and in yet another particular case, said easily-removable material represents a yellow-colored material), and according to the second embodiment, the horizontal road marking contains micro-glass beads placed onto the surface of the pavement facing the transport moving along the road surface, wherein the road surface at least contains bitumen, and micro-glass beads are placed with the partial embedment into bitumen, thus forming an extending portion located above the indicated surface, wherein a non-extending portion of said micro-glass beads is provided with an additional layer deposited onto their surface and made of an easily-removable light-type material (in a particular case, said easily-removable material represents a material of any color other than white, yellow or orange).

DISCLOSURE OF THE INVENTION

The following designations are used in the figures: 1—extending portion; 2—micro-glass bead; 3—first surface; 4—road marking layer; 5—second surface; 6—road surface; 7—microvoids; 8—additional layer; 9—mineral grain; 10—bitumen.

A road surface (6) represents the upper portion of the pavement and consists of one or several layers of the corresponding material, such as asphaltic concrete (according to par. 3.90 of the Set of Rules 34.13330.2012 "Automobile roads" approved by order No. 266 of the Ministry of Regional Development of the Russian Federation (Minregion of Russia) on Jun. 30, 2012). The material of the road surface (6) consists of a mixture of bitumen (10) and mineral grains (9). Mineral grains (9) are completely covered with bitumen (10), so that the surface layer of the road surface (6) consists entirely of bitumen (10).

A mineral grain (9) represents a particle of a mineral material (crushed stone, gravel, or sand according to par. 3.1 of GOST 9128-2013 "Asphaltic concrete and polymer asphaltic concrete mixtures, asphaltic concrete and polymer asphaltic concrete for automobile roads and airfields. Technical specifications"). Mineral grain (9) represents a solid component of asphaltic concrete, which the road surface (6) is made of.

Bitumen (10) represents a binding medium in the structure of asphaltic concrete, which the road surface (6) is made of, and represents solid or tar-like products, or a mixture of hydrocarbons and their nitrogen, oxygen, sulfur and metal-containing derivatives.

A micro-glass bead (2) represents an element close in shape to a sphere. The size of the micro-glass bead (2) is less than the thickness of the road marking layer (4). Micro-glass bead (2) is made of transparent glass.

An additional layer (8) is located on the surface of the micro-glass bead (2). The additional layer (8) is made of the material, which can be easily removed once exposed to the external factors (precipitations, UV radiation, car tires, chemical reagents), such as water-soluble paint and gouaches. The material of additional layer (8) should be of a light type (for example, comply with the chromaticity coordinates specified in GOST R 51256-11, i.e., white, orange or yellow color). The light type is characterized by the proximity to the top of the color sphere along the vertical axis (according to the definition of lightness provided on the site http://www.photorepair.ru/garmoniya-tsveta-osnovyi, access date: Nov. 9, 2016). The specified colors (orange and yellow) are characterized by the wavelength intervals related to the spectral ranges of visible light of a given type.

A road marking layer (4) represents a layer of road marking material (paint, thermoplastic or cold plastic). One linear dimension (thickness) of this layer is much smaller than the other two linear dimensions. The first surface (3) and the second surface (5) represent the largest surfaces limiting the layer. The road marking layer (4) is located on the road surface (6). In this case, the second surface (5) faces the road surface (6), and the first surface (3) is located across from the second surface (5).

In general, the road markings represent designations on the roadway, artificial structures and road facility elements intended to inform the travelers of the traffic conditions and arrangements within a road stretch (according to par. 3.1.1. of GOST R 51256-2011 "Road marking. Classification. Technical requirements").

In this case, the road marking at least contains partially embedded micro-glass beads (2) with additional layer (8) located on their surface.

According to the first embodiment, the micro-glass beads (2) with additional layer (8) on their surface are partially embedded into the road marking layer (4). At the interface between the micro-glass beads (2) (with additional layer (8) on their surface) and material of the road marking layer (4), microvoids (7) can be located. Micro-glass beads (2) partially extend from the road marking layer (4). The extending portion (1) represents a portion of the micro-glass bead (2) outside of the road marking layer (4). The extending portion (1) is located further away from the load surface (6) than the first surface (3) and second surface (5).

According to the second embodiment, the micro-glass beads (2) with additional layer (8) on their surface are partially embedded into bitumen (10). At the interface between the micro-glass beads (2) (with additional layer (8) on their surface) and bitumen (10), microvoids (7) can be located. Micro-glass beads (2) partially extend from bitumen (10). The extending portion (1) is a portion of the micro-glass bead (2), which is not embedded in bitumen (10).

BRIEF DESCRIPTION OF THE DRAWINGS

The invention is illustrated by the drawings (FIGS. 1-2), where.

INDUSTRIAL APPLICABILITY AND EMBODIMENTS OF THE INVENTION

Figure 1:
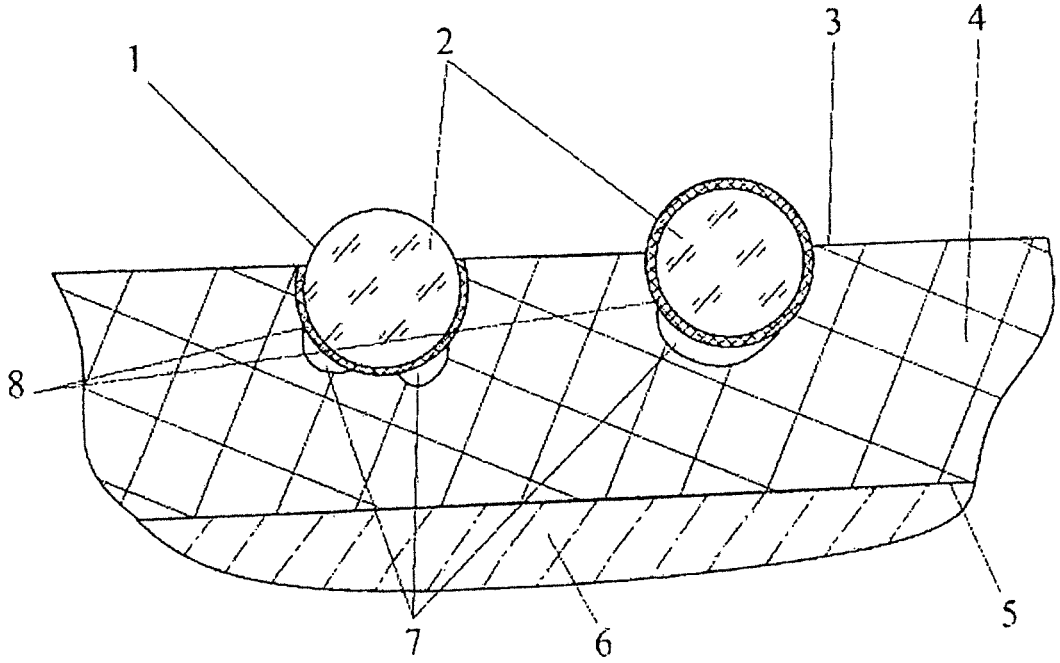
FIG. 1 shows the cross-portion of the pavement with the road markings applied thereto.

In case of using the above elements, the invention is implemented as follows.

First, the micro-glass beads (2) are coated with additional layer (8) by using a certain technique, such as spraying or dipping.

To lay the road surface (6), asphaltic concrete mixture is prepared from mineral grains (9) and bitumen (10). Laying and compaction of the asphaltic concrete mixture is performed by using, for example, an asphalt paver and a road roller (in accordance with par. 12.3 of the Set of Rules 78.13330.2012 "Automobile roads" approved by order No. 272 of the Ministry of Regional Development of the Russian Federation (Minregion of Russia) on Jun. 30, 2012).

According to the first embodiment, the road marking layer (4), which is usually less than 6 mm thick (according to par. 5.3 of GOST R 51256-2011 "Road marking. Classification. Technical requirements") and has an established configuration (according to appendices A and B of GOST R 51256-2011 "Road marking. Classification. Technical requirements"), is applied to the road surface (6). The road marking layer (4) is applied, for example, by using a special road-marking machine or manually. As a result, the first free surface (3) and the second surface (5) facing the road surface (6) are formed. The micro-glass beads (2) with additional layer (8) on their surface are applied to the first surface (3) of just applied (non-hardened) road marking layer (4) by using, for example, a pneumatic distributor of the road-marking machine. If the material of the road marking layer (4) has low viscosity, micro-glass beads (2) sink under their own weight. If the material of the road marking layer (4) is more viscous, micro-glass beads (2) are embedded by providing kinetic energy, for example, by using compressed air.

According to the second embodiment, the micro-glass beads (2) with additional layer (8) on their surface are applied onto just laid road surface (6) by using, for example, a pneumatic distributor of the road-marking machine. The micro-glass beads (2) with additional layer (8) on their surface can also be applied to a fully finished (with solidified bitumen (10)) road surface (6) by pre-heating said road surface (6) until bitumen (10) softens by using, for example, a stream of hot air. The micro-glass beads (2) are then embedded in bitumen (10) by providing kinetic energy, for example, by using compressed air.

Figure 2:
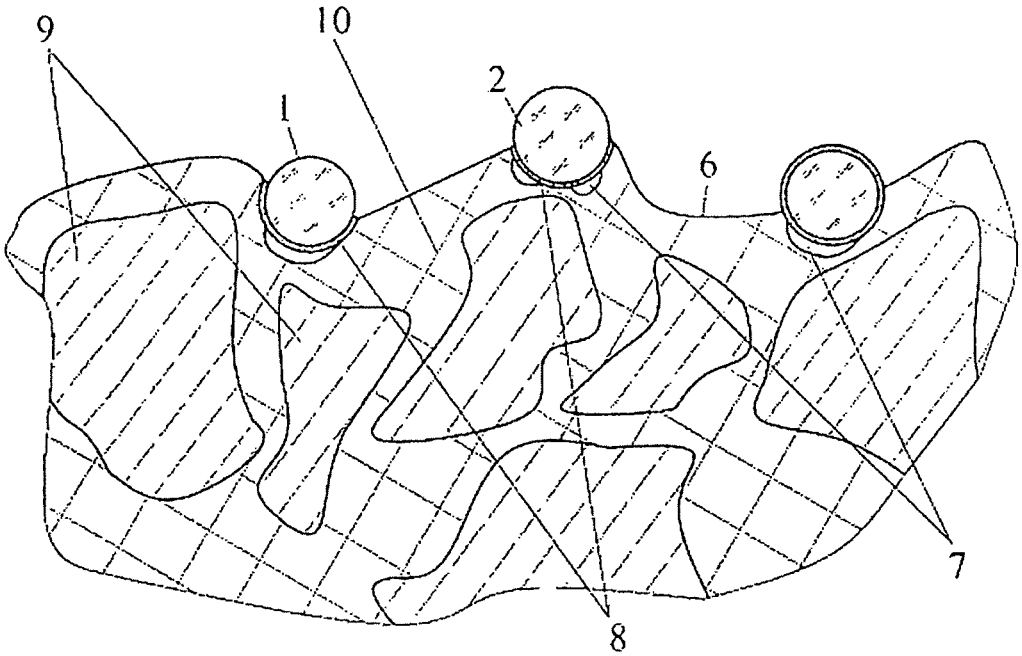
FIG. 2 shows the cross-portion of the pavement made of asphaltic concrete with applied micro-glass beads (the size ratio in the drawings is conditional).

As a result, the additional layer (8) becomes located between the micro-glass beads (2) and the material they were embedded into (material of the road marking layer (4) according to the first embodiment, and bitumen (10) according to the second embodiment). The micro-glass beads (2) are embedded partially. A non-immersed portion of the micro-glass beads (2) forms the extending portion (1). While embedding, microvoids (7) may form around the micro-glass beads (2) (with additional layer (8) on their surface). These microvoids (7) are located between the additional layer (8) and the material which micro-glass beads (2) are embedded into (material of the road marking layer (4) according to the first embodiment, and bitumen (10) according to the second embodiment). The micro-glass beads (2) with additional (not yet removed) layer (8) on the surface of the extending portion (1) are shown in FIGS. 1 and 2 on the right.

External factors (precipitations or UV radiation, exposure to car tires, chemical reagents) remove the additional layer (8) from the surface of the extending portion (1). In one instance, precipitations dissolve the material of the additional layer (8). The resulting solution flows down from the surface of the extending portion (1). In another instance, additional layer (8) is removed by the car tire treads due to mechanical impact. Mechanical removal is easily achievable due to insignificant adhesion forces between the additional layer (8) and the glass surface of the extending portion (1). As a result, in both instances, the surface of the extending portion (1) represents a clean glass surface. Micro-glass bead (2) after the additional layer (8) has been removed by the natural factors from the surface of the extending portion (1) is shown in FIG. 1 on the left and in FIG. 2 as first and second on the left.

The invention is used as follows. Light sources, such as car headlights, emit radiation, including in the form of a visible light. Majority of the light beams directly hitting the road surface (6) are absorbed. According to the first embodiment, a portion of all incident light beams is partially reflected directly from the road marking layer (4) and returns in the opposite direction. In both embodiments, a portion of light beams is incident upon the extending portion (1). Since the additional layer (8) is no longer present on the surface of the extending portion, the light beam is partially reflected and, upon refraction, enters the internal volume of the micro-glass bead (2). The light beams that have passed through the micro-glass bead (2) get almost completely reflected from the interface between glass and additional layer (8) located on the entire surface of micro-glass beads (2), except for the extending portion (1). Majority of these reflected light beams return to the light source.

In the prototype, however, the light beams undergo additional absorption by the layer of transparent glue, and a portion of the light beams that have passed through the micro-glass beads (2) enters the microvoids (7) between the surface of the micro-glass bead (2) and material of the road marking layer (4), where the light gets absorbed or scattered. Due to these factors, in case of the prototype, when the light beam returns to the light source, it is significantly weakened.

Thus, by using additional layer (8), an increase in the portion of returned light beams incident onto the extending portion (1) of the micro-glass beads (2) provides a better visibility of the road markings. The retroreflection factor and color of the reflected light are independent of the color of the road marking material and are determined only by the additional layer (8). Hence, there is no need to use high-whiteness materials in order to increase the retroreflection factor of white markings.

In case, when some road marking elements should be informative only during the dark part of the day, or if there is a need to change the color of the road surface before a dangerous portion, micro-glass beads (2) can be applied directly to a freshly laid asphaltic concrete by embedding them by ½ to ⅔ into a not yet cooled layer of bitumen (10), or by pre-heating the required portion of asphaltic concrete (i.e., according to the second embodiment).

The invention claimed is:

1. Horizontal road markings comprising a road marking layer with a first surface and a second surface, where the first surface faces transport moving along the road surface, and the second surface is placed on the road surface; and micro-glass beads located on said road marking layer partially embedded in said road marking layer such that there is an extending portion of the micro-glass beads located above the first surface, wherein said micro-glass beads within the road marking layer are provided with an additional layer of removable, water soluble paint completely covering their entire surface, said additional layer being dissolvable when exposed to precipitation, UV radiation, or chemical reagents, such that said extending portion becomes a clean glass surface when said road markings are in use.

2. The road markings according to claim 1, wherein the additional layer is a water-based paint.

3. The road markings according to claim 1, wherein the additional layer is a metal-based paint.

4. Horizontal road markings comprising micro-glass beads located on a surface of pavement facing transport moving along the road surface, where said road surface at least contains bitumen, and micro-glass beads are partially embedded into the bitumen so that there is an extending portion of the micro-glass beads located above said road surface, wherein the extending portion of the micro-glass beads are provided with an additional layer of removable, water soluble paint completely covering their entire surface, said additional layer being dissolvable when exposed to precipitation, UV radiation, car tire friction, or chemical reagents such that said extending portion becomes a clean glass surface when said road markings are in use.

* * * * *